US011056072B2

(12) United States Patent
Qiu

(10) Patent No.: US 11,056,072 B2
(45) Date of Patent: Jul. 6, 2021

(54) DISPLAY DEVICE AND REGULATION METHOD THEREFOR

(71) Applicant: HKC Corporation Limited, Shenzhen (CN)

(72) Inventor: Bin Qiu, Shenzhen (CN)

(73) Assignee: HKC Corporation Limited, Shenzhen (CN)

( * ) Notice: Subject to any disclaimer, the term of this patent is extended or adjusted under 35 U.S.C. 154(b) by 0 days.

(21) Appl. No.: 17/043,594

(22) PCT Filed: Mar. 14, 2019

(86) PCT No.: PCT/CN2019/078081
§ 371 (c)(1),
(2) Date: Sep. 29, 2020

(87) PCT Pub. No.: WO2020/087836
PCT Pub. Date: May 7, 2020

(65) Prior Publication Data

US 2021/0035521 A1 Feb. 4, 2021

(30) Foreign Application Priority Data

Oct. 29, 2018 (CN) ..... 201811269576.2

(51) Int. Cl.
*G09G 3/36* (2006.01)
*G09G 3/3275* (2016.01)
*G09G 3/3266* (2016.01)

(52) U.S. Cl.
CPC ..... *G09G 3/3688* (2013.01); *G09G 3/3275* (2013.01); *G09G 3/3266* (2013.01);
(Continued)

(58) Field of Classification Search
CPC ... G09G 2300/0426; G09G 2320/0223; G09G 2320/0233; G09G 2320/0242;
(Continued)

(56) References Cited

U.S. PATENT DOCUMENTS 9,196,185 B2 11/2015 Kim et al.
10,620,498 B2 4/2020 Chen
(Continued)

FOREIGN PATENT DOCUMENTS

CN 202268150 U 6/2012
CN 103886844 A 6/2014
(Continued)

OTHER PUBLICATIONS

International Patent Application No. PCT/CN2019/078081—International Search Report and Written Opinion with English Translation of International Search Report, dated Jul. 23, 2019, 6 pages.
(Continued)

*Primary Examiner* — Dong Hui Liang
(74) *Attorney, Agent, or Firm* — Christensen O'Connor Johnson Kindness PLLC

(57) ABSTRACT

This application relates to a display device and a regulation method therefor. The display device includes a display panel and a drive circuit. The display panel includes a display area and a fan-out area. The display area is provided with a plurality of data lines, and the fan-out area is provided with a plurality of connection lines. The drive circuit includes: a detection circuit, configured to detect resistances of connection lines, where the connection lines include a first connection line and a second connection line; a plurality of source drive circuits, where an adjustable resistors is integrated inside the source drive circuit; and a control chip, configured to compare the resistances of the first connection
(Continued)

line and the second connection line and output a control signal, where the source drive circuits adjust a resistance of the adjustable resistor according to the control signal.

20 Claims, 5 Drawing Sheets

(52) U.S. Cl.
CPC ... *G09G 3/3677* (2013.01); *G09G 2300/0452* (2013.01); *G09G 2310/08* (2013.01); *G09G 2320/0233* (2013.01); *G09G 2320/0242* (2013.01); *G09G 2320/0252* (2013.01); *G09G 2360/145* (2013.01)

(58) Field of Classification Search
CPC ..... G09G 3/3648; G09G 3/20; G09G 3/2092; G09G 3/3611
See application file for complete search history.

(56) References Cited

U.S. PATENT DOCUMENTS

2005/0219236 A1* 10/2005 Sano ..... G09G 3/3688 345/211
2015/0091444 A1 4/2015 Ebisuno
2015/0187294 A1* 7/2015 Chen ..... G09G 3/3685 345/205

FOREIGN PATENT DOCUMENTS

CN 107180594 A 9/2017
CN 109166515 A 1/2019

OTHER PUBLICATIONS

PCR (China) Patent Application No. 201811269576.2—Office Action dated May 17, 2019, 7 pages.

* cited by examiner

| | Data 1 | Data 2 | Data 3 | Data 4 | Data 5 |
|---|---|---|---|---|---|
| Gate 1 | | P1 | | | |
| Gate 2 | | B | B | B | B |
| Gate 3 | | G | G | G | G |
| Gate 4 | | R | R | R | R |
| Gate 5 | | B | B | B | B |
| Gate 6 | | G | G | G | G |
| Gate 7 | | R | R | R | R |

DISPLAY DEVICE AND REGULATION METHOD THEREFOR

CROSS REFERENCE TO RELATED APPLICATIONS

This application is a U.S. National Stage entry, filed under 35 U.S.C § 371, of International Patent Application No. PCT/CN2019/078081, filed Mar. 14, 2019, which claims priority to Chinese Patent Application No. 201811269576.2, filed with the Chinese Patent Office on Oct. 29, 2018 and entitled "DISPLAY DEVICE AND REGULATION METHOD THEREFOR", each of which is incorporated herein by reference in its entirety.

TECHNICAL FIELD

This application relates to the field of display technologies, and in particular, to a display device and a regulation method therefor.

BACKGROUND

The description herein provides only background information related to this application, but does not necessarily constitute the existing technology.

A general display principle of an exemplary display device is controlling progressive turn-on or turn-off of all pixels by using crisscrossed gate lines and data lines on a Thin Film Transistor (TFT) substrate, to realize ideal picture display. A gate drive signal and a data signal for controlling turn-on or turn-off of the pixels are sent by a control chip in the display device, and usually a Chip On Film (COF) needs to be configured to respectively transmit the gate drive signal and the data signal to the gate lines and the data lines on the TFT substrate. An exemplary processing method is a fan-out layout. The fan-out layout means that some wires connected to the gate lines and the data lines present a fan shape on the whole. Moreover, in a fan-out layout, lengths of wires on two sides of a fan-out area are far greater than those of wires in the middle of the fan-out area. Therefore, resistances of the wires on the two sides are far greater than those of the wires in the middle, resulting in severe waveform distortion of the gate drive signal or the data signal when transmitted on the wires on the two sides and generation of color shift. Further, light spots or dark spots (fan-out mura) present in the pixels controlled by the wires on the two sides of the fan-out area, affecting the display effect of the display device.

SUMMARY

Embodiments of this application provide a display device capable of alleviating light spots or dark spots that present in final display caused by inconsistent lengths of wires in a fan-out area.

In addition, further provided is a regulation method for a display device.

Provided is a display device, the display device including a display panel and a drive circuit, where the display panel includes a display area and a fan-out area, the display area is provided with a plurality of data lines, and the fan-out area is provided with a plurality of connection lines, where each data line is connected to one connection line; and the drive circuit includes:

a detection circuit, configured to detect resistances of the connection lines, where the connection lines include a first connection line and a second connection line;

a plurality of source drive circuits, where an adjustable resistor is integrated inside the source drive circuit, and the display panel is electrically connected to the adjustable resistors of the source drive circuits through the connection lines; and a control chip, where the control chip is electrically connected to the plurality of source drive circuits separately through functional pins, and the control chip is configured to compare the resistances of the first connection line and the second connection line and output a control signal according to a resistance comparison result, where the source drive circuits receive the control signal and adjust a resistance of the adjustable resistor according to the control signal, to enable the resistances of the first connection line and the second connection line to be the same in the fan-out area.

In an embodiment, a quantity of the adjustable resistors is one-to-one corresponding to a quantity of the connection lines.

In an embodiment, the display device further includes a lightness sensor, disposed on the fan-out area and configured to detect a display lightness of the fan-out area, where the control chip outputting the control signal according to a resistance comparison result is outputting the control signal according to the resistance comparison result and the display lightness; and the source drive circuits are further configured to receive the control signal and adjust the resistance of the adjustable resistor according to the control signal, to enable the resistances of the first connection line and the second connection line to be the same in the fan-out area.

In an embodiment, the display device further includes a Chip On Film disposed at an edge of the fan-out area, where the source drive circuits are disposed on the Chip On Film.

In an embodiment, the adjustable resistor is a digital potentiometer, a digital potential control circuit is integrated inside the source drive circuit, and the digital potential control circuit is configured to adjust a resistance of the digital potentiometer.

In an embodiment, the control chip is a Timing Controller.

In an embodiment, the display panel is a liquid crystal display panel.

In an embodiment, the display panel is an organic light emitting display panel.

In an embodiment, the display panel is a quantum dot light emitting display panel.

In an embodiment, a plurality of groups of resistances to be output to the adjustable resistor is stored in the digital potential control circuit in advance.

Provided is a regulation method for a display device, based on a display device, where the display device includes a display panel and a drive circuit, the display panel includes a display area and a fan-out area, the display area is provided with a plurality of data lines, and the fan-out area is provided with a plurality of connection lines, where each data line is connected to one connection line; and the drive circuit includes:

a detection circuit, configured to detect resistances of the connection lines;

a plurality of source drive circuits, where an adjustable resistor is integrated inside the source drive circuit, and the display panel is electrically connected to the adjustable resistors of the source drive circuits through the connection lines; and a control chip, where the control chip is electrically connected to the plurality of source drive circuits separately through functional pins; and the regulation method includes:

detecting the resistances of the connection lines in the fan-out area, where the connection lines include a first connection line and a second connection line;

comparing the resistances of the first connection line and the second connection line; and adjusting a resistance of the adjustable resistor according to a resistance comparison result, to enable the resistances of the first connection line and the second connection line to be the same in the fan-out area.

In an embodiment, the step of detecting the resistances of the connection lines in the fan-out area includes:

measuring trace lengths of the first connection line and the second connection line in the fan-out area; and calculating trace resistances according to the trace lengths.

In an embodiment, a calculation formula for the trace resistance is:

$$R=\rho L/S,$$

where ρ is a resistivity of the connection line and is decided by an inherent property of the connection line, L is a length of the connection line, and S is a cross-sectional area of the connection line.

In an embodiment, the step of detecting the resistances of the connection lines in the fan-out area includes:

detecting a first voltage input to the first connection line and a second voltage input to the second connection line respectively; and determining the resistances of the first connection line and second connection line according to the detected first voltage and second voltage.

In an embodiment, the step of adjusting a resistance of the adjustable resistor according to a resistance comparison result includes:

if the resistance of the first connection line is greater than that of the second connection line, controlling the resistance of the adjustable resistor that is connected to the second connection line to increase;

if the resistance of the first connection line is equal to that of the second connection line, keeping the resistance of the adjustable resistor unchanged; and if the resistance of the first connection line is less than that of the second connection line, controlling the resistance of the adjustable resistor that is connected to the first connection line to increase.

In an embodiment, the regulation method for a display device further includes:

marking the compared connection lines.

In an embodiment, the regulation method for a display device further includes:

screening the connection lines with identical lengths.

In an embodiment, the regulation method for a display device further includes:

detecting a display lightness of the fan-out area; and comparing the display lightness with a preset display lightness reference and outputting a lightness comparison result, where the step of adjusting a resistance of the adjustable resistor according to a resistance comparison result, to enable the resistances of the first connection line and the second connection line to be the same in the fan-out area is adjusting the resistance of the adjustable resistor according to the resistance comparison result and the lightness comparison result, to enable the resistances of the first connection line and the second connection line to be the same in the fan-out area.

In an embodiment, the preset display lightness reference is a display lightness of the display area during normal display.

Provided is a regulation method for a display device, including:

detecting resistances of connection lines in a fan-out area, where the connection lines include a first connection line and a second connection line;

comparing the resistances of the first connection line and the second connection line;

adjusting a resistance of an adjustable resistor according to a resistance comparison result;

detecting a display lightness of the fan-out area after the resistance is adjusted;

comparing the display lightness with a preset display lightness reference; and adjusting the resistance of the adjustable resistor according to a lightness comparison result, to enable the resistances of the first connection line and the second connection line to be the same in the fan-out area.

By the foregoing display device and regulation method therefor, resistances of traces in a fan-out area are detected and compared and a resistance of an adjustable resistor is adjusted according to a comparison result, to enable resistances of connection lines to be the same in the fan-out area, to further reduce an impedance difference caused by different lengths of the connection lines and further reduce a difference in transmission time delays of a gate drive signal or a data signal on the traces in the fan-out area. Therefore, the fan-out mura and color shift phenomena can be effectively avoided, thereby further enabling final display of a display panel to become more uniform.

BRIEF DESCRIPTION OF THE DRAWINGS

To describe the technical solutions of the embodiments of this application or the existing technology more clearly, the following briefly introduces the accompanying drawings required for describing the embodiments or the existing technology. Apparently, the accompanying drawings in the following description show only some embodiments of this application, and persons of ordinary skill in the art may still derive other drawings from these accompanying drawings without creative efforts.

DETAILED DESCRIPTION OF THE EMBODIMENTS

To help understand this application, this application will be fully described with reference to the accompanying drawings. The accompanying drawings illustrate optional embodiments of this application. However, this application can be implemented in various different forms, and is not limited to the embodiments described herein. On the contrary, the embodiments are described for the purpose of providing a more thorough and comprehensive understanding of the contents of this application.

Unless otherwise defined, all technical and scientific terms used herein have the same meaning as commonly understood by persons skilled in the art to which this application pertains. The terminology used in the description of this application herein is for describing specific embodiments only and is not intended to be limiting of this application. As used herein, the term "and/or" includes any and all combinations of one or more of the associated listed items.

Figures 1, 2:
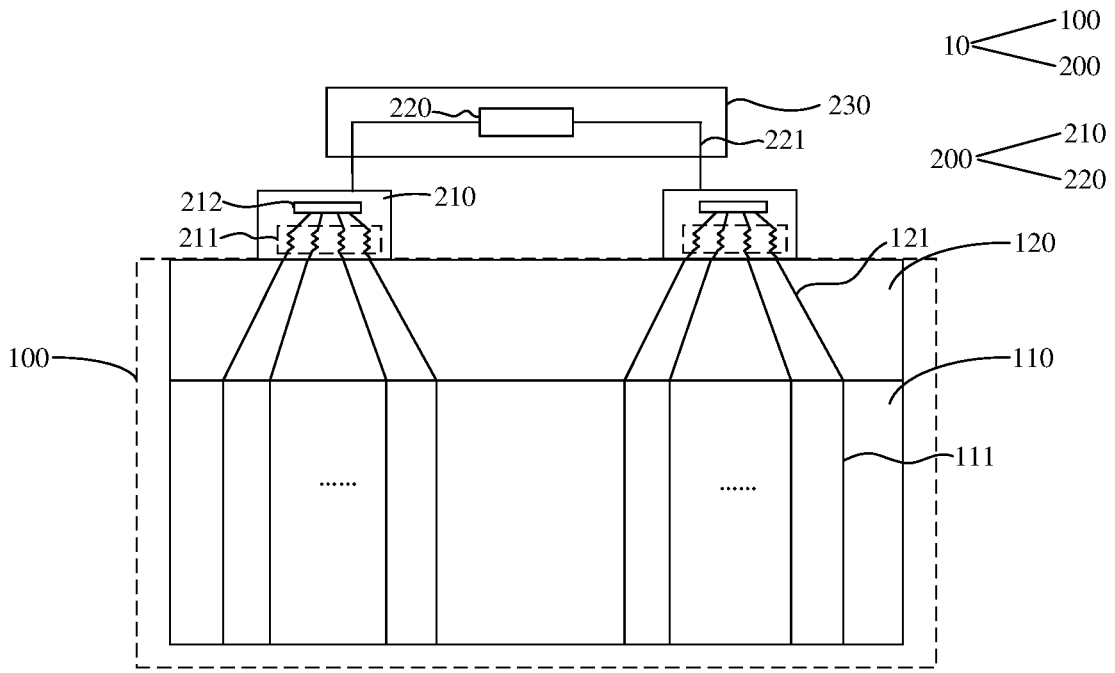
FIG. 1 is a schematic structural diagram of a display device according to an embodiment.
FIG. 2 is a schematic diagram of a pixel arrangement manner of a display area 110 in FIG. 1.

Please referring to FIG. 1, FIG. 1 is a schematic structural diagram of a display device according to an embodiment. The display device 10 may include a display panel 100 and a drive circuit 200. The display panel 100 includes a display area 110 and a fan-out area 120. The display area 110 is an area where there is picture information displayed and may also be referred to as an active area. The fan-out area 120 is an area where some wires connected to gate lines and data lines of the display area 110 present a fan shape on the whole. For convenience of distinguishing, the area where the wires are located is referred to as the fan-out area 120 or a fan-out. The display panel may be, for example, a Thin Film Transistor Liquid Crystal Display (TFT-LCD) display panel, an Organic Light Emitting Diode (OLED) display panel, a Quantum Dot Light Emitting Diode (QLED) display panel, a curved display panel, or other display panels. This application is described by using an example in which the display panel is a TFT-LCD display panel. A main drive principle of the TFT-LCD includes: a main board of a system connects R/G/B compression signals, control signals, and a power supply to connectors on a Printed Circuit Board (PCB) via leads, and the compression signals and control signals are processed by a control chip on the PCB and are then connected, via leads on the PCB, to a display area through a Source-Chip on Film (S-COF) and a Gate-Chip on Film (G-COF), to enable the LCD to obtain a needed power supply and control signal.

The display area 110 is provided with a plurality of data lines 111. As can be learned from FIG. 1, in the display area 110, trace lengths of the data lines 111 are identical. The fan-out area 120 is provided with a plurality of connection lines 121. Each data line 111 is connected to one connection line 121. Further, the drive circuit 200 may include a detection circuit (not shown in FIG. 1), source drive circuits 210, and a control chip 220. When designing a pixel matrix of a general display device, centralized layout of output traces of the source drive circuits 210 needs to be performed in a bonding area. A processing manner is a fan-out layout. Output wires in the fan-out layout are the connection lines 121 in this application. In the fan-out area 120, trace lengths of the connection lines 121 are different. A trace of the connection line 121 located in a central position of the fan-out area 120 is the shortest and the lengths of the connection lines 121 increases successively from the center to two sides. In the display area 110, the trace lengths of the data lines 111 are identical. Therefore, lengths of the connection lines 121 from outputs of the source drive circuits 210 to the display area 110 are different. As a result, impedances of the connection lines 121 in the fan-out area 120 cannot be identical, further resulting in occurrence of a fan-out mura and affecting watch experience of a user. To simplify description, the connection lines 121 are subdivided into a first connection line (not shown in FIG. 1) and a second connection line (not shown in FIG. 1). A length of the first connection line is shorter than that of the second connection line. That is, an impedance of the second connection line is greater than that of the first connection line. It should be understood that the length of the first connection line may alternatively be equal to that of the second connection line, or the length of the first connection line may be longer than that of the second connection line.

It should be understood that the display area 110 is further provided with a plurality of gate lines and a plurality of gate drive circuits configured to drive the gate lines. The gate drive circuits generate gating signals based on clock signals. The gating signals are gate line drive voltage signals. The function of the gating signals is to control write-in of color data by controlling a switch of a TFT, to further drive the display panel to display.

Specifically, as shown in FIG. 2, FIG. 2 is a schematic diagram of a pixel arrangement manner of the display area 110 in FIG. 1. A pixel unit of the display panel 100 includes three subpixels with three colors, namely, red, green, and blue, and each pixel unit is provided with one data line and three gate lines. Further, each subpixel is driven by a corresponding gate line, and each pixel unit is driven by a corresponding data line. For example, a pixel unit P1 is provided with a data line Data 1 and gate lines Gate 1, Gate 2, and Gate 3. The data line Data 1 is configured to input color data information. The gate lines Gate 1, Gate 2, and Gate 3 are respectively configured to control TFT switches of the subpixels of blue (B), red (R), and green (G), to further control write-in of color data information. However, the impedances of different connection lines 121 in the fan-out area 120 are different, and therefore insufficient write-in of some colors may be caused due to an excessively large impedance of a long connection line when controlling write-in of hybrid color image data information, resulting in chromatic aberration of image display.

Further, the detection circuit is configured to detect resistances of the first connection line and the second connection line. Exemplarily, the detection circuit may detect values of the resistances of the first connection line and the second connection line by detecting values of voltages on the first connection line and the second connection line. Typically, the resistances can be calculated by simulation using existing software. Exemplarily, simulated measurement can be performed by using resistance extraction software. Alternatively, the values of the resistances may be measured by measuring the lengths of the first connection line and the second connection line. The method is indicated by a formula of:

$$R=\rho L/S,$$

where ρ is a resistivity of the connection line and is decided by an inherent property of the connection line, L is a length of the connection line, and S is a cross-sectional area of the connection line.

Generally, the source drive circuit 210 is configured to receive a color signal output by the control chip 220 and then generate a gating signal based on the clock signal. The gating signal is a signal used for driving a corresponding data line to be turned on or to be turned off. Further, an adjustable resistor 211 is integrated inside the source drive circuit 210. The display panel 100 is electrically connected to the adjustable resistor 211 inside the source drive circuit 210 via the connection line 121.

The control chip 220 is electrically connected to a plurality of source drive circuits 210 separately through functional pins and connection leads 221. The control chip 220 is configured to compare the resistances of the first connection line the second connection line and output a control signal according to a resistance comparison result. Specifically, the control chip 220 may be a T-CON. The T-CON is mainly configured to provide clock signals for the data lines 111 and gate lines in the display area 110. In this application, the control chip 220 is further configured to compare the resistances of the first connection line and the second connection line, that is, a difference between the resistances of the first and second connection lines, output a control signal according to a resistance comparison result (a resistance difference), and transmit the control signal through the functional pin and the connection lead 221 to the source drive circuit 210. The source drive circuit 210 receives the control signal and then adjusts the resistance of the adjustable resistor 211, to enable the resistances of the first connection line and the second connection line to be the same in the fan-out area.

In the foregoing embodiment, resistances of traces in a fan-out area are detected and compared and a resistance of an adjustable resistor is adjusted according to a comparison result, to enable resistances of connection lines to be the same in the fan-out area, to further reduce an impedance difference caused by different lengths of the connection lines and further reduce a difference in transmission time delays of a gate drive signal or a data signal on the traces in the fan-out area. Therefore, the fan-out mura and color shift phenomena can be effectively avoided, thereby further enabling final display of a display panel to become more uniform.

Further, the adjustable resistor 211 may be a digital potentiometer. Correspondingly, a digital potential control circuit 212 configured to adjust a resistance of the digital potentiometer is integrated inside the source drive circuit 210. The digital potentiometer is a precise adjustable resistor, and a manner for the digital potential control circuit 212 to control the digital potentiometer is also a simple control manner. In this application, a quantity of the adjustable resistors 211 is one-to-one corresponding to a quantity of the connection lines 121. That is, an individual adjustable resistor 211 is configured for each wire in the fan-out area 120 in this application. In this way, the impedance of each connection line can be adjusted, thereby increasing flexibility of this application. Further, there are massive wires in the fan-out area 120, and therefore the quantity of the adjustable resistors 211 to be configured is quite large, resulting in that the adjustment is complex. Therefore, in this embodiment, several groups of resistances for adjustable resistors may be set in advance with respect to relationships between the lengths of the connection lines 121 in the fan-out area 120 and the resistances of the adjustable resistors for several models of display panels (for example, large-, middle-, or small-scale panel or a display panel of a typical size). In this way, a corresponding control circuit 212 directly selects, when adjustment is needed subsequently, among the several groups of resistances for adjustable resistors according to the models set in advance, and then adjusts the resistance. Therefore, the complexity of adjustment is reduced, so that the solution of this application is more flexible.

Figure 3:
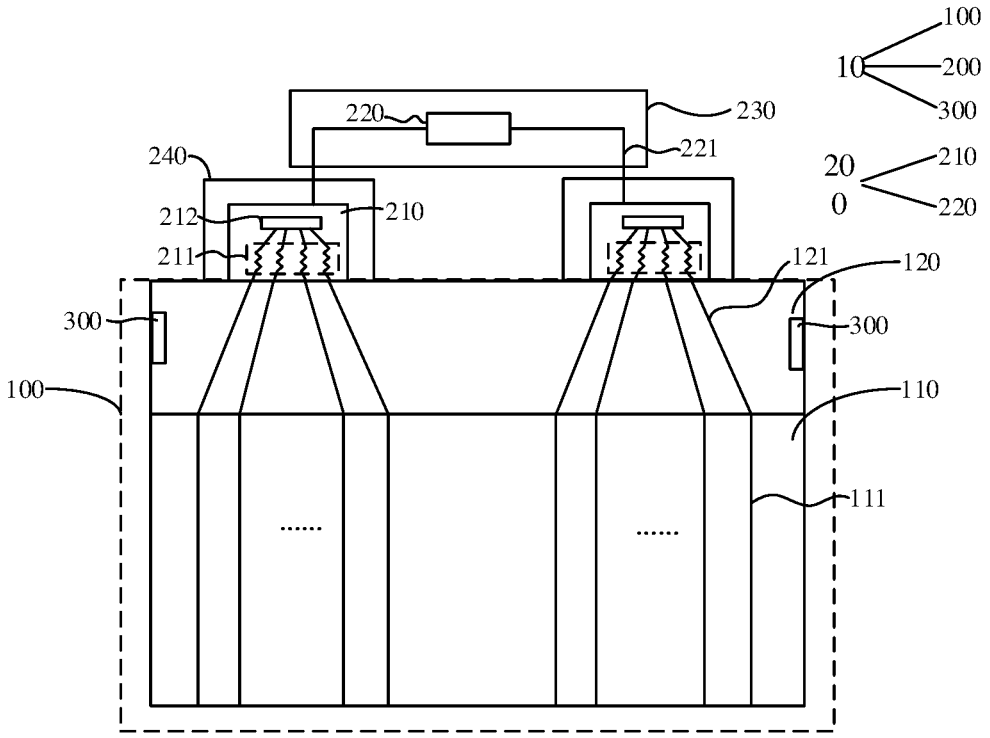
FIG. 3 is a schematic structural diagram of a display device according to another embodiment.

Further referring to FIG. 3, FIG. 3 is a schematic structural diagram of a display device according to another embodiment. The display device 10 may include a display panel 100, a drive circuit 200, and a lightness sensor 300. The display panel 100 includes a display area 110 and a fan-out area 120. The display area 110 is an area where there is picture information displayed and may also be referred to as an active area. The fan-out area 120 is an area where some wires connected to gate lines and data lines of the display area 110 present a fan shape on the whole. For convenience of distinguishing, the area where the wires are located is referred to as the fan-out area 120 or a fan-out. The display panel may be, for example, a TFT-LCD display panel, an OLED display panel, a QLED display panel, a curved display panel, or other display panels. This application is described by using an example in which the display panel is a TFT-LCD display panel. A main drive principle of the TFT-LCD includes: a main board of a system connects R/G/B compression signals, control signals, and a power supply to connectors on a PCB via leads, and the compression signals and control signals are processed by a control chip on the PCB and are then connected, via leads on the PCB, to a display area through an S-COF and a G-COF, to enable the LCD to obtain a needed power supply and control signal.

It should be understood that, specific descriptions of the display panel 100 and the drive circuit 200 may be referred to the relevant description in the foregoing embodiments, and details are not described again herein.

Still referring to FIG. 3, the display device 10 further includes a lightness sensor 300, disposed on the fan-out area 120, and configured to detect a display lightness of the fan-out area 120. In the fan-out area 120, lengths of the connection lines 121 are different, resulting in that impedances of the connection lines 121 in the fan-out area 120 cannot be identical and further resulting in occurrence of a fan-out mura. Therefore, when the fan-out mura appears in the fan-out area 120, the display lightness of the area is different from that of the display area 110. Specifically, when a light spot appears in the fan-out area 120, a value of the display lightness of the fan-out area 120 is greater than that of the display area 110. When a dark spot appears in the fan-out area 120, the value of the display lightness of the fan-out area 120 is less than that of the display area 110. Therefore, a value of the display lightness of the display area 110 during normal display is taken as a preset value, that is, an ideal image display effect.

That the control chip 220 outputs a control signal according to a resistance comparison result is that the control chip 220 outputs a control signal according to a resistance comparison result and a display lightness. That is, the control signal output by the control chip 220 to the source drive circuit 210 may be a controls signal output after combining the resistance comparison result and the display lightness. Generally, the resistance of the adjustable resistor 211 adjusted merely according to a value of the resistance in the fan-out area 120 through simulated measurement may still have a difference with an actual resistance. Therefore, to further reduce the difference, the lightness sensor 300 is disposed on the fan-out area 120 in this application to detect a display lightness of the fan-out area 120, the value of the display lightness detected in real time is compared with the preset display lightness, then the control chip 220 provides a control signal according to a resistance comparison result and a display lightness, the source drive circuit 210 receives the control signal and then controls the digital potential control circuit inside to adjust the resistance of the adjustable resistor, to enable the impedances of the connection lines in the fan-out area 120 to be identical and to further enable display of the display panel to become more uniform.

Still referring to FIG. 3, a COF 240 is further disposed at an edge of the fan-out area 120, and the source drive circuit 210 is disposed on the COF 240. The gate drive circuit may also be electrically connected to the display panel through the COF. With the development of display technologies, display devices have been widely used contributing to advantages such as high image quality, power saving, thinness, and narrow bezel. The narrow bezel enables an area of a display image of the display device to become larger, thereby improving the experience of a user. Therefore, to reduce an area of a bezel, the gate drive circuit in this application uses a Gate driver on Array (GOA) technology, which means integrating a gate drive circuit on an array substrate of a display panel, so that the part of the gate drive on circuit can be omitted, to reduce product costs in aspect of material costs and manufacturing processing.

In the foregoing embodiment, resistances of traces in a fan-out area are detected and compared, a display lightness of the fan-out area is detected, and a resistance of an adjustable resistor is adjusted according to the resistance comparison result and the display lightness, to enable resistances of connection lines to be the same in the fan-out area, to further reduce an impedance difference caused by different lengths of the connection lines and further reduce a difference in transmission time delays of a gate drive signal or a data signal on the traces in the fan-out area. Therefore, the fan-out mura and color shift phenomena can be effectively avoided, thereby further enabling final display of a display panel to become more uniform.

Figure 4:
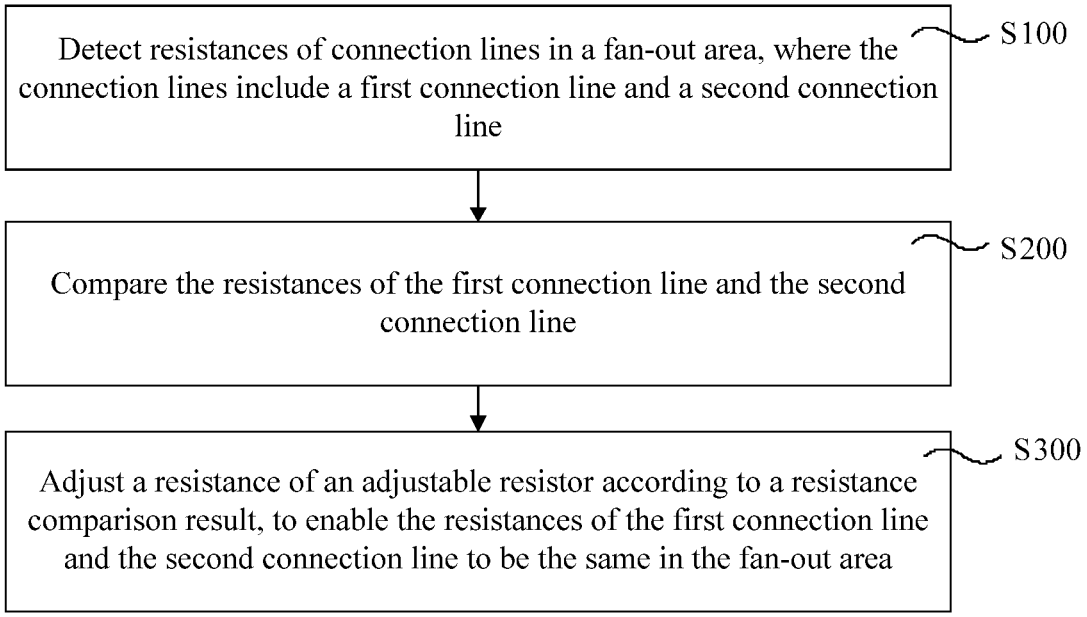
FIG. 4 is a schematic flowchart of a regulation method for a display device according to an embodiment.

Referring to FIG. 4, FIG. 4 is a schematic flowchart of a regulation method for a display device according to an embodiment. The regulation method is based on the display device described in the foregoing embodiments. The regulation method may include steps S100-S300.

Step S100: Detect resistances of connection lines in a fan-out area, where the connection lines may include a first connection line and a second connection line.

Specifically, additionally referring to FIG. 1, when designing a pixel matrix of a general display device, centralized layout of output traces of the source drive circuits 210 needs to be performed in a bonding area. A processing manner is a fan-out layout. Output wires in the fan-out layout are the connection lines 121 in this application. In the fan-out area 120, trace lengths of the connection lines 121 are different. A trace of the connection line 121 located in a central position of the fan-out area 120 is the shortest and the lengths of the connection lines 121 increases successively from the center to two sides. In the display area 110, the trace lengths of the data lines 111 are identical. Therefore, lengths of the connection lines 121 from outputs of the source drive circuits 210 to the display area 110 are different. As a result, impedances of the connection lines 121 in the fan-out area 120 cannot be identical, further resulting in occurrence of a fan-out mura and affecting watch experience of a user. To simplify description, the connection lines 121 are subdivided into a first connection line (not shown in FIG. 1) and a second connection line (not shown in FIG. 1). A length of the first connection line is shorter than that of the second connection line. That is, an impedance of the second connection line is greater than that of the first connection line. It should be understood that the length of the first connection line may alternatively be equal to that of the second connection line, or the length of the first connection line may be longer than that of the second connection line.

Figure 5:
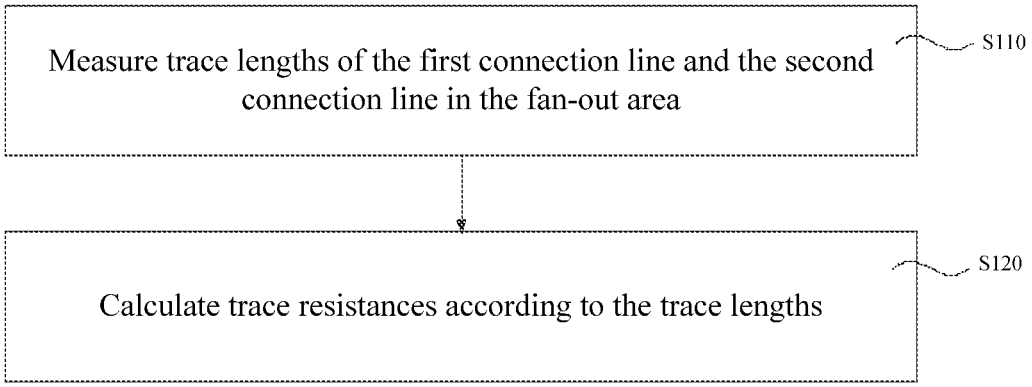
FIG. 5 is a specific schematic flowchart of step S100 in FIG. 4.

Further, referring to FIG. 5, step S100 may include steps S110-S120.

Step S110: Measure trace lengths of the first connection line and the second connection line in the fan-out area.

Step S120: Calculate trace resistances according to the trace lengths.

Specifically, values of the resistances of the first connection line and the second connection line may be measured by using the following formula:

$$R=\rho L/S,$$

where ρ is a resistivity of the connection line and is decided by an inherent property of the connection line, L is a length of the connection line, and S is a cross-sectional area of the connection line.

It should be understood that the fan-out area 120 is further provided with a plurality of connection lines, and two of the connection lines are used as an example for description herein; this should not be understood as a further limitation to this application.

Step S200: Compare the resistances of the first connection line and the second connection line.

Specifically, the resistances of the first connection line and the second connection line are compared by using the control chip 220 in the display device 10. The control chip 220 may directly compare the values of the resistances, or may compare the resistances of the first connection line and the second connection line by detecting values of voltages input to the first connection line and the second connection line.

Step S300: Adjust a resistance of an adjustable resistor according to a resistance comparison result, to enable the resistances of the first connection line and the second connection line to be the same in the fan-out area.

Figure 6:
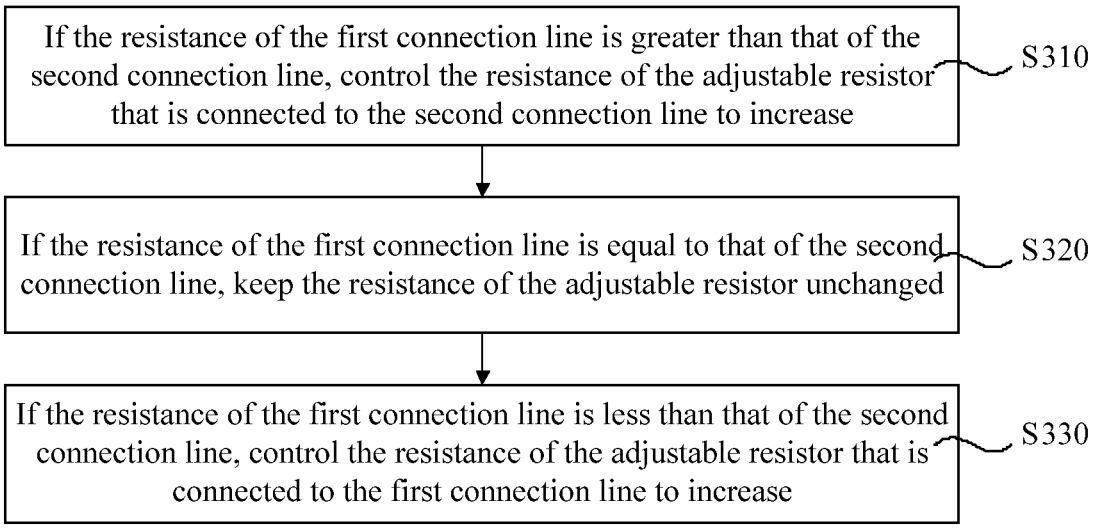
FIG. 6 is a specific schematic flowchart of step S300 in FIG. 4.

Specifically, referring to FIG. 6, step S300 may include steps S310-S330.

Step S310: If the resistance of the first connection line is greater than that of the second connection line, control the resistance of the adjustable resistor that is connected to the second connection line to increase.

Specifically, according to the detected resistances of the first connection line and the second connection line, the resistances of the two connection lines are further compared. If the resistance of the first connection line is greater than that of the second connection line, the resistance of the adjustable resistor that is connected to the second connection line is controlled to increase. The process mainly includes: the control chip 220 outputs a control signal according to the comparison result and the source drive circuit receives the control signal and then controls the digital potential control circuit inside to adjust the resistance of the corresponding adjustable resistor. For example, the second connection line is a line part in a central area of the fan-out area 120 and the first connection line is a line part close to two ends of the fan-out area 120. A result obtained after detection and comparison certainly is that the impedance of the first connection line (long) is greater than that of the second connection line (short). At this time, it is only necessary to control the resistance of the adjustable resistor that is connected to the second connection line to increase to be the same as that of the first connection line. Similarly, the corresponding resistances of the other connection lines may also increase according to such method. There are massive wires in the fan-out area 120, and therefore the quantity of the adjustable resistors 211 to be configured is quite large, resulting in that the adjustment is complex. Therefore, in this embodiment, several groups of resistances for adjustable resistors may be set in advance with respect to relationships between the lengths of the connection lines 121 in the fan-out area 120 and the resistances of the adjustable resistors for several models of display panels (for example, large-, middle-, or small-scale display panel or a display panel of a typical size). In this way, a corresponding control circuit 212 directly selects, when adjustment is needed subsequently, among the several groups of resistances for adjustable resistors according to the models set in advance, and then adjusts the resistance. Therefore, the complexity of adjustment is reduced, so that the solution of this application is more flexible.

Further, problems such as a repeated comparison may exist in comparisons of two lines. For example, there are wires at two ends of the fan-out area 120 with the same length. After one of the two connection lines is compared with another wire, the other one of the two connection lines may be further compared with the another wire. In this case, wires with the same length or a wire on which comparison has been performed may be marked or screened, to further reduce complexity and unnecessary calculating process, thereby reducing costs and complexity.

Further, a uniform resistance may also be set for the connection lines. The uniform resistance may be set by using a resistance of the wire with the largest length in the fan-out area 120 as a reference. In this way, subsequent adjustment is performed merely according to the set resistance.

Step S320: If the resistance of the first connection line is equal to that of the second connection line, keep the resistance of the adjustable resistor unchanged.

Specifically, when the detected resistance of the first connection line is equal to that of the second connection line, the resistance of the adjustable resistor is kept unchanged.

Step S330: If the resistance of the first connection line is less than that of the second connection line, control the resistance of the adjustable resistor that is connected to the first connection line to increase.

Specifically, methods for detecting, comparing, and adjusting the resistances of the first connection line and the second connection line may be referred to relevant description in step S310, with the difference in that this step concerns a situation in which the resistance of the first connection line is less than that of the second connection line and the resistance of the adjustable resistor that is connected to the first connection line needs to be increased. Details are not described again herein.

In the foregoing embodiment, resistances of connection lines in a fan-out area are detected and compared and a resistance of an adjustable resistor corresponding to a connection line with a smaller resistance is adjusted according to a comparison result, to enable resistances of connection lines to be the same in the fan-out area, to further reduce an impedance difference caused by different lengths of the connection lines and further reduce a difference in transmission time delays of a gate drive signal or a data signal on the traces in the fan-out area. Therefore, the fan-out mura and color shift phenomena can be effectively avoided, thereby further enabling final display of a display panel to become more uniform.

Figure 7:
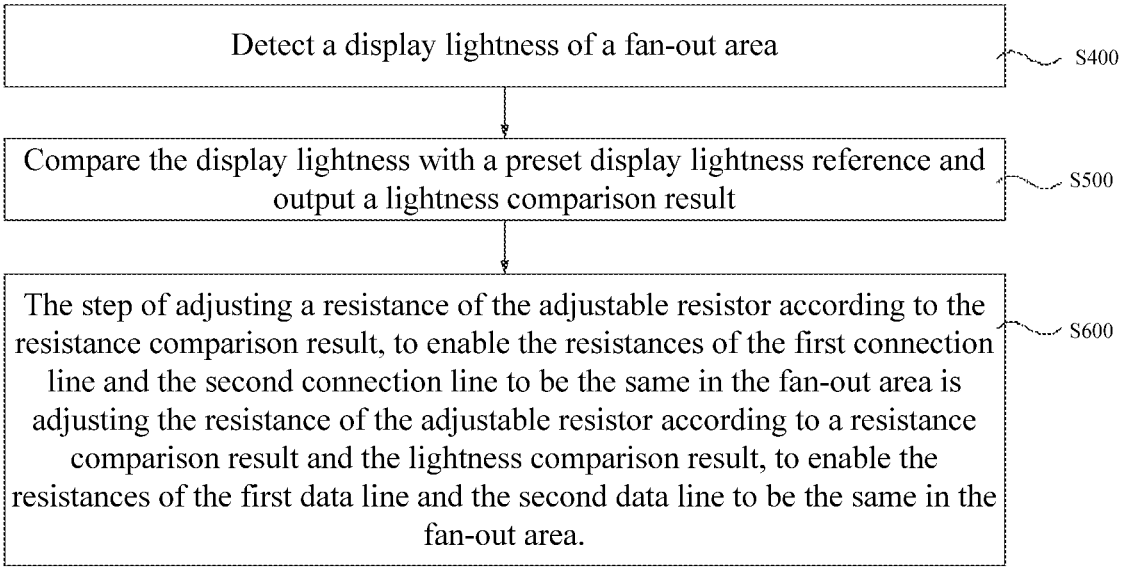
FIG. 7 is a schematic flowchart of a regulation method for a display device according to another embodiment.

Referring to FIG. 7, FIG. 7 is a schematic flowchart of a regulation method for a display device according to another embodiment. The regulation method may include steps S400-S600.

Step S400: Detect a display lightness of a fan-out area.

Step S500: Compare the display lightness with a preset display lightness reference and output a lightness comparison result.

Specifically, in the fan-out area 120, lengths of the connection lines 121 are different, resulting in that impedances of the connection lines 121 in the fan-out area 120 cannot be identical and further resulting in occurrence of a fan-out mura. Therefore, when the fan-out mura appears in the fan-out area 120, the display lightness of the area is different from that of the display area 110. Specifically, when a light spot appears in the fan-out area 120, a value of the display lightness of the fan-out area 120 is greater than that of the display area 110. When a dark spot appears in the fan-out area 120, the value of the display lightness of the fan-out area 120 is less than that of the display area 110. Therefore, a value of the display lightness of the display area 110 during normal display is taken as a preset display lightness reference, that is, an ideal image display effect. The control chip 220 performs comparison for the display lightness of the fan-out area 120 and then outputs a corresponding lightness comparison result.

Step S600: The step of adjusting a resistance of an adjustable resistor according to a resistance comparison result, to enable the resistances of the first connection line and the second connection line to be the same in the fan-out area is adjusting a resistance of an adjustable resistor according to a resistance comparison result and the lightness comparison result, to enable the resistances of the first connection line and the second connection line to be the same in the fan-out area. That is, the adjustment of the resistance of the adjustable resistor performed by the source drive circuit 210 according to the resistance comparison result may be an adjustment made after combining the resistance comparison result and the display lightness. Generally, the resistance of the adjustable resistor 211 adjusted merely according to a value of the resistance in the fan-out area 120 through simulated measurement may still have a difference with an actual resistance. Therefore, to further reduce the difference, the lightness sensor 300 is disposed on the fan-out area 120 in this application to detect a display lightness of the fan-out area 120, the value of the display lightness detected in real time is compared with the preset display lightness, then the control chip 220 provides a control signal according to a resistance comparison result and a display lightness, the source drive circuit 210 receives the control signal and then controls the digital potential control circuit inside to adjust the resistance of the adjustable resistor, to enable the impedances of the connection lines in the fan-out area 120 to be identical and to further enable display of the display panel to become more uniform.

In the foregoing embodiment, resistances of traces in a fan-out area are detected and compared, a display lightness of the fan-out area is detected, and a resistance of an adjustable resistor is adjusted according to the resistance comparison result and the display lightness, to enable resistances of connection lines to be the same in the fan-out area, to further reduce an impedance difference caused by different lengths of the connection lines and further reduce a difference in transmission time delays of a gate drive signal or a data signal on the traces in the fan-out area. Therefore, the fan-out mura and color shift phenomena can be effectively avoided, thereby further enabling final display of a display panel to become more uniform.

Figure 8:
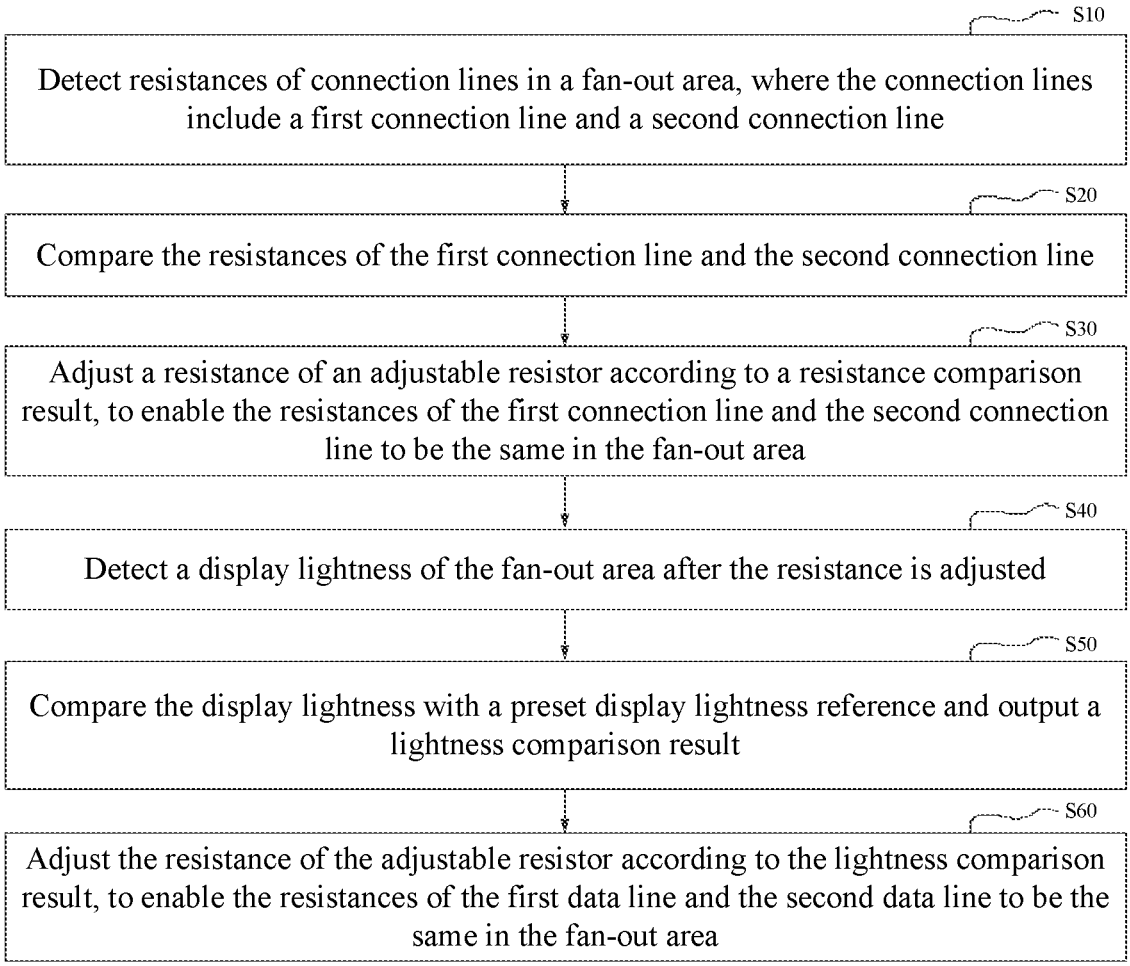
FIG. 8 is a schematic flowchart of a regulation method for a display device according to still another embodiment.

Further referring to FIG. 8, FIG. 8 is a schematic flowchart of a regulation method for a display device according to still another embodiment. The regulation method may include steps S10-S60.

Step S10: Detect resistances of connection lines in a fan-out area, where the connection lines include a first connection line and a second connection line.

Step S20: Compare the resistances of the first connection line and the second connection line.

Step S30: Adjust a resistance of an adjustable resistor according to a resistance comparison result, to enable the resistances of the first connection line and the second connection line to be the same in the fan-out area.

Step S40: Detect a display lightness of the fan-out area after the resistance is adjusted.

Step S50: Compare the display lightness with a preset display lightness reference and output a lightness comparison result.

Step S60: Adjust the resistance of the adjustable resistor according to the lightness comparison result, to enable the resistances of the first connection line and the second connection line to be the same in the fan-out area.

It should be understood that descriptions of steps S10-S30 may be referred to relevant description of steps S100-S300 in the foregoing regulation method, and are not described in detail again herein. Further, the detection and comparison of the lightness in steps S40-S60 and the adjustment of the adjustable resistor may also be referred to relevant descriptions in the foregoing embodiments. The difference with the foregoing embodiments lies in that: in this embodiment, first the resistance of the adjustable resistor is adjusted according to the resistances, after the resistance of the adjustable resistor is adjusted, the display lightness of the fan-out area is detected, the detected display lightness is then compared with a preset display lightness reference, and the resistance of the adjustable resistor is dynamically adjusted according to a comparison result, so as to enable the resistances of the first connection line and the second connection line to be the same in the fan-out area.

In the foregoing embodiment, resistances of traces in a fan-out area are detected and compared, then a resistance of an adjustable resistor is adjusted according to a resistance comparison result, a display lightness of the fan-out area is detected after the resistance is adjusted, the detected display lightness is compared with a preset display lightness reference, and the resistance of the adjustable resistor is dynamically adjusted according to a comparison result, to enable resistances of connection lines to be the same in the fan-out area, to further reduce an impedance difference caused by different lengths of the connection lines and further reduce a difference in transmission time delays of a gate drive signal or a data signal on the traces in the fan-out area. Therefore, the fan-out mura and color shift phenomena can be effectively avoided, thereby further enabling final display of a display panel to become more uniform.

Technical features in the foregoing embodiments may be combined randomly. For the brevity of description, not all possible combinations of various technical features in the foregoing embodiments are described. However, as long as combinations of these technical features do not contradict each other, it should be considered that the combinations all fall within the scope of this specification.

The foregoing embodiments only show several implementations of this application and are described in detail, but they should not be construed as a limit to the patent scope of this application. It should be noted that, a person of ordinary skill in the art may make various changes and improvements without departing from the concepts of this application, which shall all fall within the protection scope of this application. Therefore, the protection scope of the patent of this application shall be subject to the appended claims.

What is claimed is:

1. A display device, the display device comprising a display panel and a drive circuit, wherein the display panel comprises a display area and a fan-out area, the display area is provided with a plurality of data lines, and the fan-out area is provided with a plurality of connection lines, wherein each data line is connected to one connection line; and the drive circuit comprises:

a detection circuit, configured to detect resistances of the connection lines, wherein the connection lines comprise a first connection line and a second connection line;

a plurality of source drive circuits, wherein an adjustable resistor is integrated inside the source drive circuit, and the display panel is electrically connected to the adjustable resistors of the source drive circuits through the connection lines; and a control chip, wherein the control chip is electrically connected to the plurality of source drive circuits separately through functional pins, and the control chip is configured to compare the resistances of the first connection line and the second connection line and output a control signal according to a resistance comparison result, wherein the source drive circuits receive the control signal and adjust a resistance of the adjustable resistor according to the control signal, to enable the resistances of the first connection line and the second connection line to be the same in the fan-out area.

2. The display device according to claim 1, wherein the adjustable resistor is a digital potentiometer, a digital potential control circuit is integrated inside the source drive circuit, and the digital potential control circuit is configured to adjust a resistance of the digital potentiometer.

3. The display device according to claim 2, wherein a plurality of groups of resistances to be output to the adjustable resistor is stored in the digital potential control circuit in advance.

4. The display device according to claim 1, wherein a quantity of the adjustable resistors is one-to-one corresponding to a quantity of the connection lines.

5. The display device according to claim 1, further comprising a lightness sensor, disposed on the fan-out area and configured to detect a display lightness of the fan-out area, wherein the control chip outputting the control signal according to a resistance comparison result is outputting the control signal according to the resistance comparison result and the display lightness; and the source drive circuits are further configured to receive the control signal and adjust the resistance of the adjustable resistor according to the control signal, to enable the resistances of the first connection line and the second connection line to be the same in the fan-out area.

6. The display device according to claim 1, further comprising a Chip On Film disposed at an edge of the fan-out area, wherein the source drive circuits are disposed on the Chip On Film.

7. The display device according to claim 1, wherein the control chip is a Timing Controller.

8. The display device according to claim 1, wherein the display panel is a liquid crystal display panel.

9. The display device according to claim 1, wherein the display panel is an organic light emitting display panel.

10. The display device according to claim 1, wherein the display panel is a quantum dot light emitting display panel.

11. A regulation method for a display device, based on a display device, wherein the display device comprises a display panel and a drive circuit, the display panel comprises a display area and a fan-out area, the display area is provided with a plurality of data lines, and the fan-out area is provided with a plurality of connection lines, wherein each data line is connected to one connection line; and the drive circuit comprises:

a detection circuit, configured to detect resistances of the connection lines;

a plurality of source drive circuits, wherein an adjustable resistor is integrated inside the source drive circuit, and the display panel is electrically connected to the adjustable resistors of the source drive circuits through the connection lines; and a control chip, wherein the control chip is electrically connected to the plurality of source drive circuits separately through functional pins; and the regulation method comprises:

detecting the resistances of the connection lines in the fan-out area, wherein the connection lines comprise a first connection line and a second connection line;

comparing the resistances of the first connection line and the second connection line; and adjusting a resistance of the adjustable resistor according to a resistance comparison result, to enable the resistances of the first connection line and the second connection line to be the same in the fan-out area.

12. The regulation method for a display device according to claim 11, wherein the step of detecting the resistances of the connection lines in the fan-out area comprises:

measuring trace lengths of the first connection line and the second connection line in the fan-out area; and calculating trace resistances according to the trace lengths.

13. The regulation method for a display device according to claim 12, wherein a calculation formula for the trace resistance is:

$$R=\rho L/S,$$

wherein ρ is a resistivity of the connection line and is decided by an inherent property of the connection line, L is a length of the connection line, and S is a cross-sectional area of the connection line.

14. The regulation method for a display device according to claim 11, further comprising:

detecting a display lightness of the fan-out area; and comparing the display lightness with a preset display lightness reference and outputting a lightness comparison result, wherein the step of adjusting a resistance of the adjustable resistor according to a resistance comparison result, to enable the resistances of the first connection line and the second connection line to be the same in the fan-out area is adjusting the resistance of the adjustable resistor according to the resistance comparison result and the lightness comparison result, to enable the resistances of the first connection line and the second connection line to be the same in the fan-out area.

15. The regulation method for a display device according to claim 14, wherein the preset display lightness reference is a display lightness of the display area during normal display.

16. The regulation method for a display device according to claim 11, wherein the step of detecting the resistances of the connection lines in the fan-out area comprises:

detecting a first voltage input to the first connection line and a second voltage input to the second connection line respectively; and determining the resistances of the first connection line and second connection line according to the detected first voltage and second voltage.

17. The regulation method for a display device according to claim 11, wherein the step of adjusting a resistance of the adjustable resistor according to a resistance comparison result comprises:

if the resistance of the first connection line is greater than that of the second connection line, controlling the resistance of the adjustable resistor that is connected to the second connection line to increase;

if the resistance of the first connection line is equal to that of the second connection line, keeping the resistance of the adjustable resistor unchanged; and if the resistance of the first connection line is less than that of the second connection line, controlling the resistance of the adjustable resistor that is connected to the first connection line to increase.

18. The regulation method for a display device according to claim 11, further comprising:

marking the compared connection lines.

19. The regulation method for a display device according to claim 11, further comprising:

screening the connection lines with identical lengths.

20. A regulation method for a display device, comprising:

detecting resistances of connection lines in a fan-out area, wherein the connection lines comprise a first connection line and a second connection line;

comparing the resistances of the first connection line and the second connection line;

adjusting a resistance of an adjustable resistor according to a resistance comparison result;

detecting a display lightness of the fan-out area after the resistance is adjusted;

comparing the display lightness with a preset display lightness reference; and adjusting the resistance of the adjustable resistor according to a lightness comparison result, to enable the resistances of the first connection line and the second connection line to be the same in the fan-out area.

* * * * *